US012781136B2

(12) United States Patent
Al-Herz et al.

(10) Patent No.: US 12,781,136 B2
(45) Date of Patent: Nov. 3, 2026

(54) PROCESSES FOR PRODUCING PETROCHEMICAL PRODUCTS THAT UTILIZE FLUID CATALYTIC CRACKING

(71) Applicant: Saudi Arabian Oil Company, Dhahran (SA)

(72) Inventors: Mansour Ali Al-Herz, Sl-Ahsa (SA); Yousif Al Hammadi, Qatif (SA)

(73) Assignee: Saudi Arabian Oil Company, Dhahran (SA)

( * ) Notice: Subject to any disclaimer, the term of this patent is extended or adjusted under 35 U.S.C. 154(b) by 173 days.

(21) Appl. No.: 18/419,057

(22) Filed: Jan. 22, 2024

(65) Prior Publication Data

US 2025/0236797 A1 Jul. 24, 2025

(51) Int. Cl.
*C10G 51/06* (2006.01)
*C10G 11/18* (2006.01)

(52) U.S. Cl.
CPC .... *C10G 11/182* (2013.01); *C10G 2300/1037* (2013.01); *C10G 2300/308* (2013.01); (Continued)

(58) Field of Classification Search
CPC ..... C10G 11/182; C10G 2300/1037; C10G 2300/308; C10G 2300/4006; C10G 2300/708; C10G 51/06; C10G 11/18
See application file for complete search history.

(56) References Cited

U.S. PATENT DOCUMENTS 3,784,463 A 1/1974 Reynolds et al.
5,318,085 A 6/1994 Vekselman
(Continued)

FOREIGN PATENT DOCUMENTS

WO 2009073436 A2 6/2009
WO 2010009077 A2 1/2010
(Continued)

OTHER PUBLICATIONS

Al-Absi et al., "Thermal and catalytic cracking of whole crude oils at high severity", Journal of Analytical and Applied Pyrolysis, vol. 145, pp. 104705, 11 pages, 2020.
(Continued)

*Primary Examiner* — Michelle Stein
(74) *Attorney, Agent, or Firm* — Dinsmore & Shohl LLP

(57) ABSTRACT

Embodiments are directed to a method for operating a fluidized catalytic cracker comprising: reacting a heavy hydrocarbon feed and a first catalyst to produce a first cracked effluent and a first spent catalyst with coke deposited thereon; reacting a light hydrocarbon feed and a second catalyst to produce a second cracked effluent and a second spent catalyst with coke deposited thereon; regenerating the first spent catalyst and the second spent catalyst in a common regenerator, by combusting coke deposited on the first spent catalyst and the second spent catalyst, thereby forming fresh catalyst, which is passed back to the first reaction zone as the first catalyst and to the second reaction zone as the second catalyst, wherein: the first reaction zone and the second reaction zone are each fluidized catalytic cracking zones operated at high severity conditions; and the common regenerator is operated without supplemental fuel or catalyst coolers.

19 Claims, 3 Drawing Sheets

(52) U.S. Cl.
CPC ..... *C10G 2300/4006* (2013.01); *C10G 2300/708* (2013.01)

(56) References Cited

U.S. PATENT DOCUMENTS

| | | | | |
|---|---|---|---|---|
| 7,019,187 | B2 | 3/2006 | Powers | |
| 7,261,807 | B2 | 8/2007 | Henry et al. | |
| 7,491,315 | B2 | 2/2009 | Eng et al. | |
| 8,137,533 | B2 | 3/2012 | Towler et al. | |
| 9,896,627 | B2 | 2/2018 | Koseoglu | |
| 10,059,642 | B1 | 8/2018 | Al-Herz et al. | |
| 10,954,457 | B2 | 3/2021 | Al-Herz et al. | |
| 11,434,437 | B1 * | 9/2022 | Zhang | B01J 23/92 |
| 11,629,299 | B1 | 4/2023 | Islam et al. | |
| 11,866,660 | B1 | 1/2024 | Al Herz et al. | |
| 2005/0211603 | A1 | 9/2005 | Guillaume et al. | |
| 2011/0083996 | A1 | 4/2011 | Shafi et al. | |
| 2013/0006028 | A1 | 1/2013 | Xie et al. | |
| 2013/0248421 | A1 * | 9/2013 | Abba | C10G 11/18 208/80 |
| 2014/0275673 | A1 | 9/2014 | Long et al. | |
| 2017/0226433 | A1 | 8/2017 | Podrebarac | |
| 2018/0244591 | A1 | 8/2018 | Al-Herz et al. | |
| 2018/0346827 | A1 | 12/2018 | Al-Ghamdi et al. | |
| 2019/0040328 | A1 | 2/2019 | Koseoglu | |
| 2020/0255753 | A1 | 8/2020 | Al-Herz et al. | |
| 2020/0291306 | A1 | 9/2020 | Aitani et al. | |
| 2021/0284921 | A1 | 9/2021 | Marri et al. | |
| 2022/0064546 | A1 | 3/2022 | Al-Ghrami et al. | |
| 2022/0098493 | A1 * | 3/2022 | Akah | B01J 38/16 |

FOREIGN PATENT DOCUMENTS

| | | | |
|---|---|---|---|
| WO | 2010009082 | A1 | 1/2010 |
| WO | 2010009089 | A2 | 1/2010 |
| WO | 2013142563 | A2 | 9/2013 |
| WO | 2014062465 | A1 | 4/2014 |

OTHER PUBLICATIONS

Notification of Transmittal of the International Search Report and the Written Opinion of the International Searching Authority, or the Declaration dated Jan. 28, 2025 pertaining to International application No. PCT/US2024/052773 filed Oct. 24, 2024, pp. 1-15.

* cited by examiner

PROCESSES FOR PRODUCING PETROCHEMICAL PRODUCTS THAT UTILIZE FLUID CATALYTIC CRACKING

TECHNICAL FIELD

Embodiments of the present disclosure generally relate to chemical processing and, more specifically, to processes and systems utilizing fluid catalytic cracking.

BACKGROUND

The worldwide increasing demand for light olefins (such as ethylene, propylene, and butylenes) remains a major challenge for many integrated refineries. In particular, the production of ethylene and propylene has attracted increased attention as pure olefin streams are considered the building blocks for polymer synthesis. Light olefins may be produced through fluid catalytic cracking processes. Typical hydrocarbon feeds for fluid catalytic cracking ("FCC") processes range from hydrocracked bottoms to heavy feed fractions such as vacuum gas oil and atmospheric residue. However, these hydrocarbon feeds are limited in supply.

During the operation of an FCC, a feedstock is reacted in the presence of a catalyst, which forms coke on the surface of the catalyst, thereby deactivating the catalyst. The coked catalyst is passed to a regenerator where the coke is combusted to regenerate and heat the catalyst. The hot, regenerated catalyst is then passed back to the reactor where it provides heat for endothermic cracking reactions. However, the amount of heat provided by the coke is often insufficient, requiring the use of coking agents and/or supplemental fuel. Alternatively, the amount of coke formed is often too great, requiring the use of expensive catalyst cooling systems in order to prevent the FCC reactor from overheating.

BRIEF SUMMARY

Accordingly, there is an ongoing need for integrated processes which can produce intermediate chemical compounds from relatively common hydrocarbon feeds with minimal processing required, and which operate in the absence of supplemental fuels, coking agents, and catalyst coolers. Embodiments of the present disclosure meet this need by providing a method for operating an FCC with two reaction zones and a common regenerator, where different feeds are passed to each reaction zone, such that, with proper selection of the feeds, coke from the first reaction zone can balance a lack of coke from the second reaction zone. The feed to the first reaction zone may comprise a whole crude oil. The feed to the second reaction zone may comprise a whole crude oil or a whole gas condensate and may be lighter (e.g., having a lesser API gravity, a lesser boiling point range, or both) than the feed to the first reaction zone. The use of crude hydrocarbon feeds with these distinct API gravities may balance the heat load between the two reactions, obviating the need for supplemental fuels or catalyst coolers. Further, the use of these whole, relatively unprocessed hydrocarbon feeds enables the use of widely available feedstocks with minimal processing.

According to one or more embodiments, a method for operating a fluidized catalytic comprises: passing a heavy hydrocarbon feed and a first catalyst to a first reaction zone to produce a first cracked effluent and a first spent catalyst with coke deposited thereon; passing a light hydrocarbon feed and a second catalyst to a second reaction zone to produce a second cracked effluent and a second spent catalyst with coke deposited thereon; passing the first spent catalyst and the second spent catalyst to a common regenerator; in the common regenerator, regenerating the first spent catalyst and the second spent catalyst by combusting coke deposited on the first spent catalyst and the second spent catalyst, thereby forming fresh catalyst, which is passed back to the first reaction zone as the first catalyst and to the second reaction zone as the second catalyst, wherein: the light hydrocarbon feed has an API gravity of from 38° to 55°; the heavy hydrocarbon feed comprises a crude oil and has an API gravity of from 20° to 35°; the first reaction zone and the second reaction zone are each fluidized catalytic cracking zones operated at high severity conditions; and the common regenerator is operated without supplemental fuel or catalyst coolers.

These and other embodiments are described in more detail in the Detailed Description. It is to be understood that both the foregoing general description and the following detailed description present embodiments of the presently disclosed technology, and are intended to provide an overview or framework for understanding the nature and character of the technology as it is claimed. The accompanying drawings are included to provide a further understanding of the presently disclosed technology and are incorporated into and constitute a part of this specification. The drawings illustrate various embodiments and, together with the description, serve to explain the principles and operations of the presently disclosed technology. Additionally, the drawings and descriptions are meant to be merely illustrative, and are not intended to limit the scope of the claims in any manner.

BRIEF DESCRIPTION OF THE DRAWINGS

The following detailed description of specific embodiments of the present disclosure can be best understood when read in conjunction with the following drawings, where like structure is indicated with like reference numerals and in which.

Figure 1:
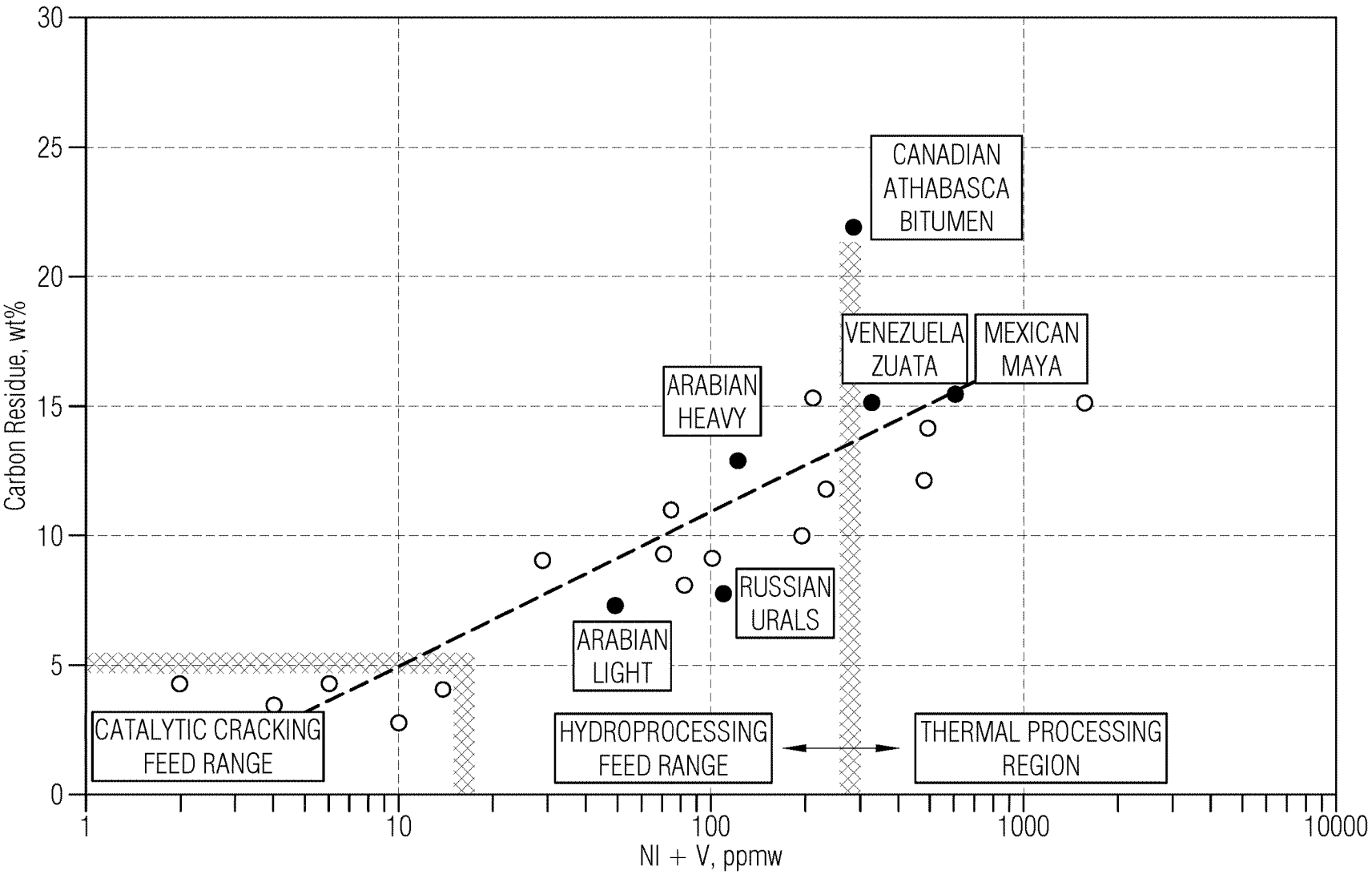
FIG. 1 graphically depicts relative properties of various hydrocarbon feed streams used for producing one or more petrochemical products, according to one or more embodiments described in this disclosure.

For the purpose of describing the simplified schematic illustrations and descriptions of the relevant figures, the numerous valves, temperature sensors, electronic controllers and the like that may be employed and well known to those of ordinary skill in the art of certain chemical processing operations are not included. Further, accompanying components that are often included in typical chemical processing operations, such as air supplies, catalyst hoppers, and flue gas handling systems, are not depicted. However, operational components, such as those described in the present disclosure, may be added to the embodiments described in this disclosure.

It should further be noted that arrows in the drawings refer to process streams. However, the arrows may equivalently refer to transfer lines which may serve to transfer process streams between two or more system components. Additionally, arrows that connect to system components define inlets or outlets in each given system component. The arrow direction corresponds generally with the major direction of movement of the materials of the stream contained within the physical transfer line signified by the arrow. Furthermore, arrows which do not connect two or more system components signify a product stream which exits the depicted system or a system inlet stream which enters the depicted system. Product streams may be further processed in accompanying chemical processing systems or may be commercialized as end products. System inlet streams may be streams transferred from accompanying chemical processing systems or may be non-processed feedstock streams. Some arrows may represent recycle streams, which are effluent streams of system components that are recycled back into the system. However, it should be understood that any represented recycle stream, in some embodiments, may be replaced by a system inlet stream of the same material, and that a portion of a recycle stream may exit the system as a system product.

Additionally, arrows in the drawings may schematically depict process steps of transporting a stream from one system component to another system component. For example, an arrow from one system component pointing to another system component may represent "passing" a system component effluent to another system component, which may include the contents of a process stream "exiting" or being "removed" from one system component and "introducing" the contents of that product stream to another system component. It should be understood that arrows in the relevant figures are not indicative of necessary or essential steps.

It should be understood that according to the embodiments presented in the relevant figures, an arrow between two system components may signify that the stream is not processed between the two system components. In other embodiments, the stream signified by the arrow may have substantially the same composition throughout its transport between the two system components. Additionally, it should be understood that in one or more embodiments, an arrow may represent that at least 75 wt. %, at least 90 wt. %, at least 95 wt. %, at least 99 wt. %, at least 99.9 wt. %, or even 100 wt. % of the stream is transported between the system components. As such, in some embodiments, less than all of the streams signified by an arrow may be transported between the system components, such as if a slip stream is present.

It should be understood that two or more process streams are "mixed" or "combined" when two or more lines intersect in the schematic flow diagrams of the relevant figures. Mixing or combining may also include mixing by directly introducing both streams into a like reactor, separation device, or other system component. For example, it should be understood that when two streams are depicted as being combined directly prior to entering a separation unit or reactor, that in some embodiments the streams could equivalently be introduced into the separation unit or reactor and be mixed in the reactor.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

Figure 2:
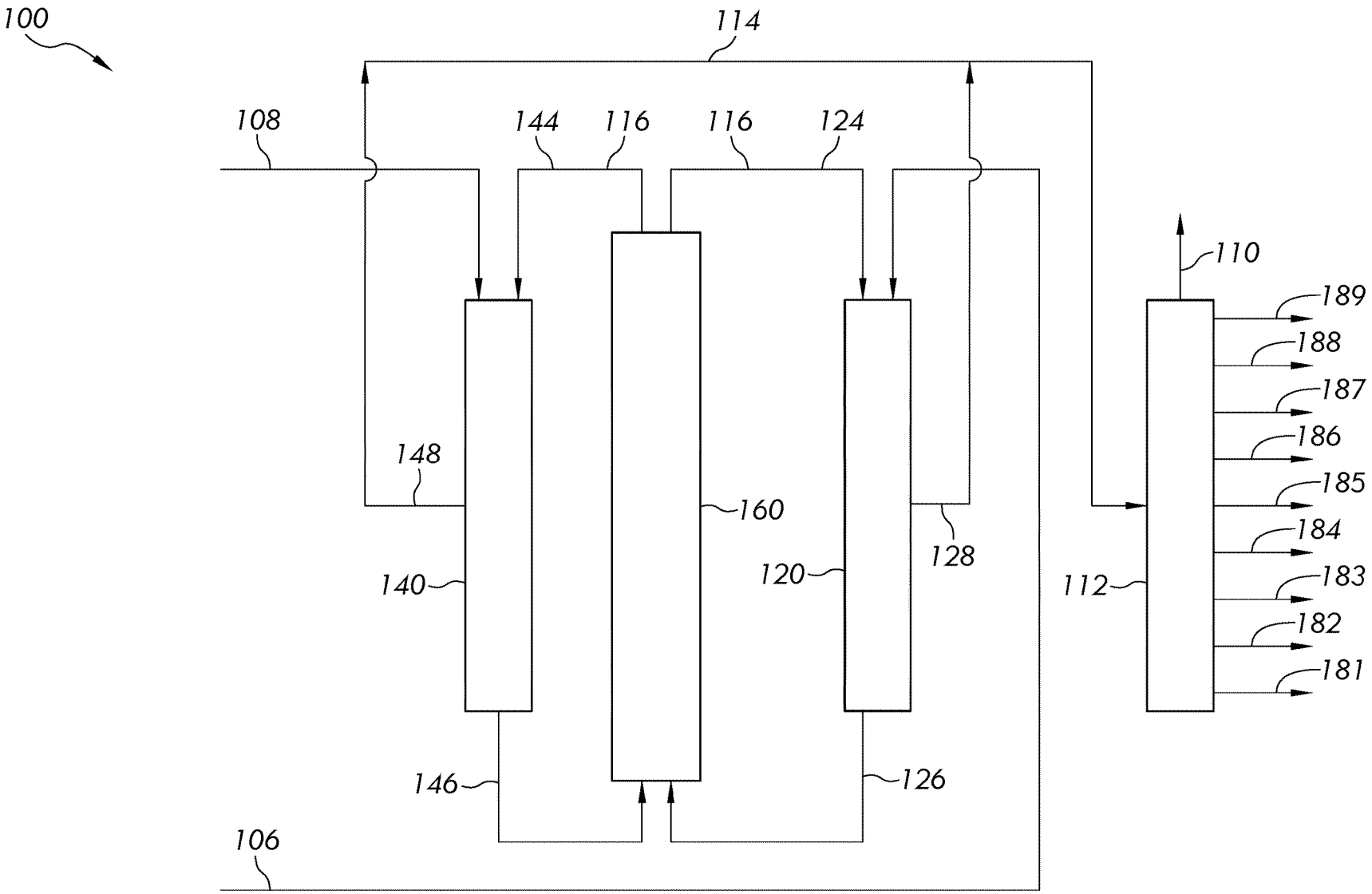
FIG. 2 is a generalized schematic diagram of a hydrocarbon feed conversion system, according to one or more embodiments described in this disclosure.
Figure 3:
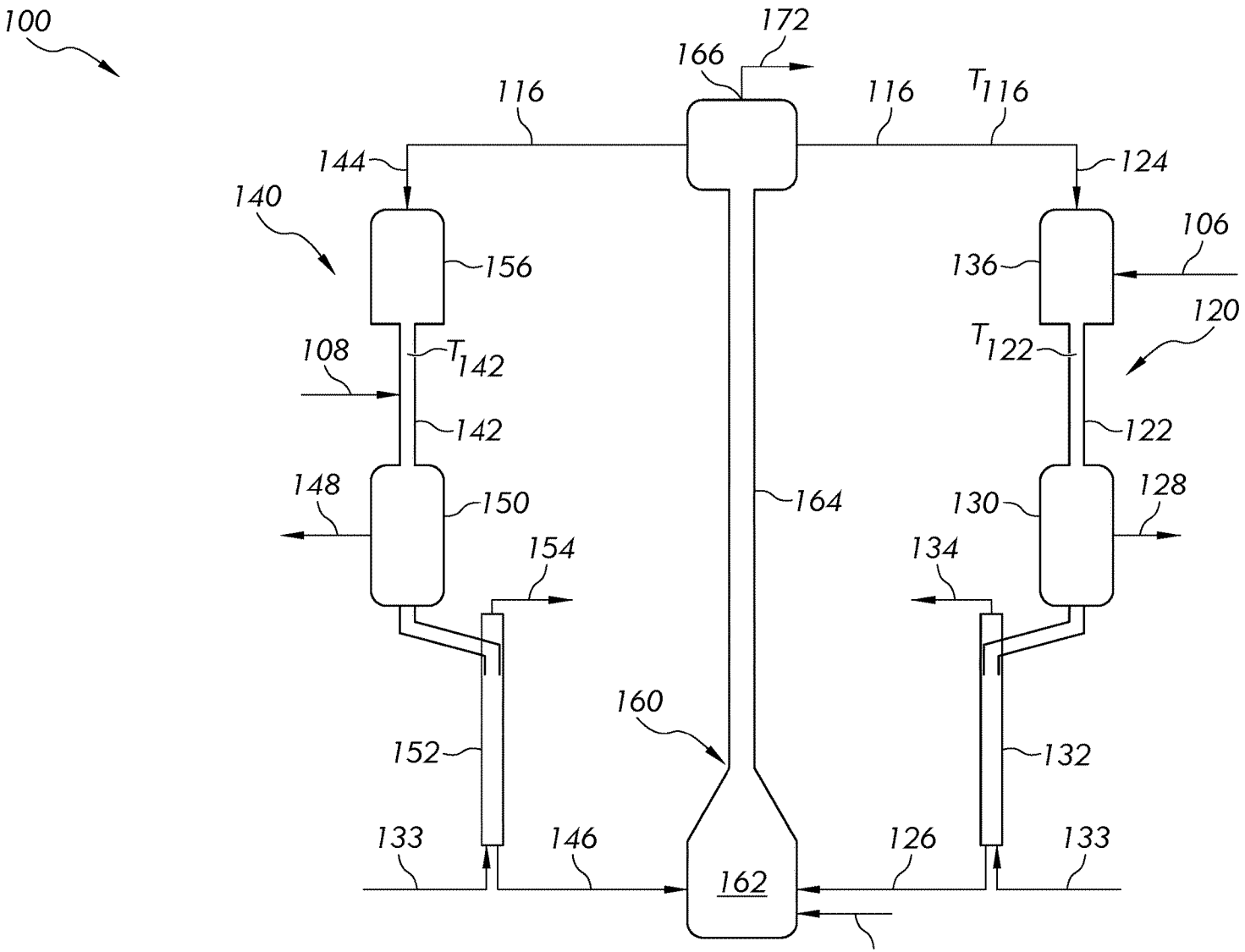
FIG. 3 depicts a schematic diagram of at least a portion of the hydrocarbon feed conversion system of FIG. 2 system, according to one or more embodiments described in this disclosure.

Embodiments of the present disclosure relate to method for operating a fluidized catalytic cracker. In general, these methods are described herein in the context of one or more systems, shown in the drawings. The embodiments of FIGS. 2-3 are similar or identical in many ways, respectively, but include differences as described herein. Description of the embodiments of FIGS. 2-3 may generally apply to the embodiments of the other figures, as would be understood by those skilled in the art. For example, concepts disclosed herein applicable to FIG. 2 may be equally applicable to FIG. 3, and vice versa, even if not explicitly stated as such herein.

As used in this disclosure, a "reactor" refers to a vessel in which one or more chemical reactions may occur between one or more reactants optionally in the presence of one or more catalysts. For example, a reactor may include a tank or tubular reactor configured to operate as a batch reactor, a continuous stirred-tank reactor ("CSTR"), or a plug flow reactor. Example reactors include packed bed reactors such as fixed bed reactors, and fluidized bed reactors. One or more "reaction zones" may be disposed in a reactor. As used in this disclosure, a "reaction zone" refers to an area where a particular reaction takes place in a reactor. For example, a packed bed reactor with multiple catalyst beds may have multiple reaction zones, where each reaction zone is defined by the area of each catalyst bed.

As used in this disclosure, a "separation unit" refers to any separation device that at least partially separates one or more chemicals that are mixed in a process stream from one another. For example, a separation unit may selectively separate differing chemical species, phases, or sized material from one another, forming one or more chemical fractions. Examples of separation units include, without limitation, distillation columns, flash drums, knock-out drums, knock-out pots, centrifuges, cyclones, filtration devices, traps, scrubbers, expansion devices, membranes, solvent extraction devices, and the like. It should be understood that separation processes described in this disclosure may not completely separate all of one chemical constituent from all of another chemical constituent. It should be understood that the separation processes described in this disclosure "at least partially" separate different chemical components from one another, and that even if not explicitly stated, it should be understood that separation may include only partial separation. As used in this disclosure, one or more chemical constituents may be "separated" from a process stream to form a new process stream. Generally, a process stream may enter a separation unit and be divided, or separated, into two or more process streams of desired composition.

As used in this disclosure, the term "high-severity conditions" generally refers to FCC temperatures of 500° C. or greater, a weight ratio of catalyst to hydrocarbon ("catalyst to oil ratio" or "CTO") of equal to or greater than 5:1, and a residence time of less than 3 seconds, all of which may be more severe than typical FCC reaction conditions.

It should be understood that an "effluent" generally refers to a stream that exits a system component such as a separation unit, a reactor, or reaction zone, following a particular reaction or separation, and generally has a different composition (at least proportionally) than the stream that entered the separation unit, reactor, or reaction zone.

As used in this disclosure, a "catalyst" refers to any substance that increases the rate of a specific chemical reaction. Catalysts described in this disclosure may be utilized to promote various reactions, such as, but not limited to, cracking (including aromatic cracking), demetallization, desulfurization, and denitrogenation. As used in this disclosure, "cracking" generally refers to a chemical reaction where carbon-carbon bonds are broken. For example, a molecule having carbon to carbon bonds is broken into more than one molecule by the breaking of one or more of the carbon to carbon bonds, or is converted from a compound which includes a cyclic moiety, such as a cycloalkane, cycloalkane, naphthalene, an aromatic or the like, to a compound which does not include a cyclic moiety or contains fewer cyclic moieties than prior to cracking.

As used in this disclosure, the term "first catalyst" refers to catalyst that is introduced to the first FCC reactor unit, such as the catalyst passed to the first FCC reactor unit. The first catalyst may include at least one of regenerated catalyst, spent first catalyst, spent second catalyst, fresh catalyst, or combinations of these. As used in this disclosure, the term "second catalyst" refers to catalyst that is introduced to the second reaction zone, such as the catalyst passed to the second reaction zone. The second catalyst may include at least one of regenerated catalyst, spent first catalyst, spent second catalyst, fresh catalyst, or combinations of these.

As used in this disclosure, the term "spent catalyst" refers to catalyst that has been introduced to and passed through a reaction zone to crack a hydrocarbon material, such as the heavy hydrocarbon feed or the light hydrocarbon feed for example, but has not been regenerated in the regenerator following introduction to the reaction zone. The "spent catalyst" may have coke deposited on the catalyst and may include partially coked catalyst as well as fully coked catalysts. The amount of coke deposited on the "spent catalyst" may be greater than the amount of coke remaining on the regenerated catalyst following regeneration. The "second spent catalyst" may refer to spent catalyst which was coked in the second FCC reactor unit since its last regeneration. The "first spent catalyst" may refer to spent catalyst which was coked in the first reaction zone since its last regeneration.

As used in this disclosure, the term "regenerated catalyst" refers to catalyst that has been introduced to a reaction zone and then regenerated in a regenerator to heat the catalyst to a greater temperature, oxidize and remove at least a portion of the coke from the catalyst to restore at least a portion of the catalytic activity of the catalyst, or both. The "regenerated catalyst" may have less coke, a greater temperature, or both compared to spent catalyst and may have greater catalytic activity compared to spent catalyst. The "regenerated catalyst" may have more coke and lesser catalytic activity compared to fresh catalyst that has not passed through a reaction zone and regenerator.

It should further be understood that streams may be named for the components of the stream, and the component for which the stream is named may be the major component of the stream (such as comprising from 50 weight percent ("wt. %"), from 70 wt. %, from 90 wt. %, from 95 wt. %, from 99 wt. %, from 99.5 wt. %, or even from 99.9 wt. % of the contents of the stream to 100 wt. % of the contents of the stream). It should also be understood that components of a stream are disclosed as passing from one system component to another when a stream comprising that component is disclosed as passing from that system component to another. For example, a disclosed "propylene stream" passing from a first system component to a second system component should be understood to equivalently disclose "propylene" passing from a first system component to a second system component, and the like.

Referring now to FIGS. 2 and 3, in general terms, the hydrocarbon feed conversion system 100 includes two FCC reaction zones in each of which a hydrocarbon feed stream contacts heated fluidized catalytic particles in a reaction zone maintained at high-severity temperatures and pressures. When the portion of the hydrocarbon feed stream contacts the hot catalyst and is cracked to lighter products, carbonaceous deposits, commonly referred to as coke, form on the catalyst. The coke deposits formed on the catalyst may reduce the catalytic activity of the catalyst or deactivate the catalyst. Deactivation of the catalyst may result in the catalyst becoming catalytically ineffective. The spent catalyst having coke deposits may be separated from the cracking reaction products, stripped of removable hydrocarbons, and passed to a regeneration process where the coke is burned from the catalyst in the presence of air to produce a regenerated catalyst that is catalytically effective. The term "catalytically effective" refers to the ability of the regenerated catalyst to increase the rate of cracking reactions. The term "catalytic activity" refers to the degree to which the regenerated catalyst increases the rate of the cracking reactions and may be related to a number of catalytically active sites available on the catalyst. For example, coke deposits on the catalyst may cover up or block catalytically active sites on the spent catalyst, thus, reducing the number of catalytically active sites available, which may reduce the catalytic activity of the catalyst. Following regeneration, the regenerated catalyst may have equal to or less than 10 wt. %, 5 wt. %, or even 1 wt. % coke based on the total weight of the regenerated catalyst. The combustion products may be removed from the regeneration process as a flue gas stream. The heated regenerated catalysts may then be recycled back to the reaction zone of the FCC units.

Referring still to FIGS. 2 and 3, a hydrocarbon feed conversion system 100 is schematically depicted. The hydrocarbon feed conversion system 100 may be a high-severity fluid catalytic cracking ("HSFCC") system. The hydrocarbon feed conversion system 100 generally receives a heavy hydrocarbon feed 106 and light hydrocarbon feed 108 and directly processes the heavy hydrocarbon feed 106 and light hydrocarbon feed 108 to produce one or more system product streams. The hydrocarbon feed conversion system 100 may include a first FCC reactor unit 120, a second FCC reactor unit 140, and a common regenerator 160. These system components and their various arrangements will be described in detail herein.

In some embodiments, a light hydrocarbon feed 108 may be passed to second FCC reactor unit 140 to form second cracked effluent 148 and second spent catalyst 146. Similarly, a heavy hydrocarbon feed 106 may be passed to first FCC reactor unit 120 to form first cracked effluent 128 and first spent catalyst 126.

The heavy hydrocarbon feed 106 may comprise a whole crude oil. The crude oil may be a raw hydrocarbon which has not been previously processed, such as through one or more of distillation, cracking, hydroprocessing, desalting, or dehydration. In embodiments, the crude oil may have undergone at least some processing, such as desalting, solids separation, scrubbing, desulfurization, or combinations of these, but has not been subjected to separation by boiling point (e.g., distillation). For instance, the crude oil may be a de-salted crude oil that has been subjected to a de-salting process or a hydrotreated crude oil that has been subjected to a hydrotreating process. In embodiments, crude oil may not have undergone pretreatment, separation (such as distillation), or other operation that changes the hydrocarbon composition of the crude oil prior to introducing the crude oil to the process. As used herein, the "hydrocarbon composition" of the crude oil refers to the composition of the hydrocarbon constituents of the crude oil and does not include entrained non-hydrocarbon solids, salts, water, or other non-hydrocarbon constituents. The heavy hydrocarbon feed 106 oil may have an American Petroleum Institute ("API") gravity of from 20° to 35°, such as an API gravity of from 20° to 33°, from 20° to 30°, from 20° to 28°, from 20° to 26°, from 20° to 24°, from 22° to 35°, from 24° to 35°, from 24° to 30°, from 26° to 35°, from 28° to 35°, from 30° to 35°, from 32° to 35°, from 22.5° to 32.5°, from 25° to 30°, or any combination of these ranges. In embodiments, the heavy hydrocarbon feed 106 may be an Arab Heavy Crude Oil (a crude oil having an API gravity of approximately 26.8°). Example properties of an Arab Heavy Crude oil are provided in Table 1.

TABLE 1

| | Units | Value |
|---|---|---|
| Analysis | | |
| American Petroleum Institute (API) gravity | Degree | 26.8 |
| Density | grams per cubic centimeter (g/cm$^3$) | 0.8904 |
| Sulfur Content | weight percent (wt. %) | 2.83 |
| Nickel | parts per million by weight (ppmw) | 16.4 |
| Vanadium | Ppmw | 56.4 |
| Sodium Chloride (NaCl) Content | Ppmw | <5 |
| Conradson Carbon Residue (CCR) | wt. % | 8.2 |
| $C_5$ Asphaltenes | wt. % | 7.8 |
| $C_7$ Asphaltenes | wt. % | 4.2 |

The light hydrocarbon feed 108 may comprise hydrocarbons, such as at least 90 wt. %, at least 95 wt. %, or at least 99 wt. % of hydrocarbons on the basis of the total weight of the light hydrocarbon feed 108. The light hydrocarbon feed 108 may be a crude oil or a gas condensate. Gas condensate (also referred to as natural gas liquids or natural gas condensate) refers to a mixture of relatively low-boiling hydrocarbon liquids obtained by condensation of the vapors of these relatively low-boiling hydrocarbon liquid constituents either in the natural gas well or as the natural gas stream emits from the well. The light hydrocarbon feed 108 may be a raw hydrocarbon which has not been previously processed, such as through one or more of distillation, cracking, hydroprocessing, desalting, or dehydration. In embodiments, the light hydrocarbon feed 108 may have undergone at least some processing, such as desalting, solids separation, scrubbing, desulfurization, or combinations of these, but has not been subjected to distillation. For instance, the light hydrocarbon feed 108 may be a de-salted hydrocarbon feed stream that has been subjected to a de-salting process or a hydrotreated hydrocarbon feed stream that has been subjected to a hydrotreating process but not to a distillation process. In embodiments, light hydrocarbon feed 108 may not have undergone pretreatment, separation (such as distillation), or other operation that changes the hydrocarbon composition of the crude hydrocarbon stream prior to introducing the hydrocarbon stream to the process. The light hydrocarbon feed 108 may have an API gravity of from 38° to 55°, such as from 40° to 55°, from 42° to 55°, from 44° to 55°, from 46° to 55°, from 48° to 55°, from 50° to 55°, from 52° to 55°, from 38° to 52°, from 38° to 50°, from 38° to 48°, from 38° to 46°, from 38° to 44°, from 38° to 43°, from 40.5° to 52.5°, from 43° to 50°, from 45.5 to 47.5°, or any subset thereof. In embodiments, the light hydrocarbon feed 108 may comprise an Arab Extra Light Crude Oil (a crude oil having an API gravity of approximately 40.5°) or a Khuff Gas Condensate (a gas condensate having an API gravity of approximately 52.26°).

In embodiments, the light hydrocarbon feed 108 has a greater API gravity than the heavy hydrocarbon feed 106. Generally, heavier hydrocarbon feeds (i.e., those with a lower API gravity) will produce more coke when cracked than lighter hydrocarbon feeds will. Therefore, the combination of a light hydrocarbon feed 108 with a greater API gravity than the heavy hydrocarbon feed 106 may enable the operator to tune coke production (and therefore heat production in the common regenerator 160) by selecting feeds with differing API gravities. In embodiments, the API gravity of the light hydrocarbon feed 108 may be at least 5°, such as at least 10°, at least 12°, at least 15°, at least 20°, or at least 25°, from 5° to 30°, from 5° to 50°, from 5° to 25°, from 10° to 30°, from 12° to 30°, from 12° to 25°, from 15° to 30°, from 20° to 30°, from 25° to 50°, from 25° to 40°, from 25° to 35°, from 25° to 30°, or any combination of these ranges higher than the API gravity of the heavy hydrocarbon feed 106.

In embodiments, the ratio of the flowrate of heavy hydrocarbon feed 106 may be at least 5% greater, such as at least 10%, at least 20%, from 5% to 50%, from 5% to 10%, from 10% to 15%, from 15% to 20%, from 20% to 25%, from 25% to 30%, from 30% to 40%, from 40% to 50% or any combination of these ranges greater than the flowrate of the light hydrocarbon feed 108, In one or more embodiments, the light and heavy hydrocarbon feed streams are preheated before being injected to the reactor. The preheating temperature for the feed and the regenerated catalyst temperature are controlled via the catalyst-to-oil ratio. The flowrates of the hydrocarbon feeds may regulated by flow controllers through the feed injectors. The pressure of each feed injector may determine the flowrate of the light and heavy hydrocarbon feed. The atomized hydrocarbon feed may mix with dispersion steam when injected into the reactor.

Referring now to FIG. 1, various hydrocarbon feed streams to be converted in a conventional FCC process are generally required to satisfy certain criteria in terms of the metals content and the Conradson Carbon Residue ("CCR") or Ramsbottom carbon content. The CCR of a feed material is a measurement of the residual carbonaceous materials that remain after evaporation and pyrolysis of the feed material. Greater metals content and CCR of a feed stream may lead to more rapid deactivation of the catalyst. For greater levels of CCR, more energy may be needed in the regeneration step to regenerate the catalyst. For example, certain hydrocarbon feeds, such as residual oils, contain refractory components such as polycyclic aromatics which are difficult to crack and promote coke formation in addition to the coke formed during the catalytic cracking reaction. Because of the greater levels of CCR of these certain hydrocarbon feeds, the burning load on the regenerator is increased to remove the coke and residue from the spent catalysts to transform the spent catalysts to regenerated catalysts. This requires modification of the regenerator to be able to withstand the increase burning load without experiencing material failure. In addition, certain hydrocarbon feeds to the FCC may contain large amounts of metals, such as nickel, vanadium, or other metals for example, which may rapidly deactivate the catalyst during the cracking reaction process. For example, the light hydrocarbon feed may include less than 2.0 wt. % CCR, less than 1.0 CCR, or less than 0.1 wt. % CCR, whereas the heavy hydrocarbon feed may have more than 2.0 wt. % CCR, or more than 5.0 wt. % CCR.

Referring again to FIGS. 2 and 3, one or more supplemental feed streams (not shown) may be added to the light hydrocarbon feed 108, the heavy hydrocarbon feed 106, or both to introducing the hydrocarbon feeds to their respective reaction zones. As previously described, in one or more embodiments, the heavy hydrocarbon feed 106 may be a crude oil. The light hydrocarbon feed 108 may be a crude oil or a whole gas condensate.

In some embodiments not shown in the figures, coke precursors may be added to the heavy hydrocarbon feed 106 or the light hydrocarbon feed 108 before their introduction to their respective reaction zones. Coke precursors are compounds intended to increase the production of coke during a reaction. Contemplated coke precursors include polycyclic aromatic compounds. Further contemplated coke precursors include torch oil comprising a mixture of light cycle oil (e.g., oil having a boiling point of from 216° C. to 359° C.) and slurry oil (e.g., oil having a boiling point of greater than 359° C.). In embodiments, the coke precursors may contact the catalyst after the catalyst leaves the reactor and before the catalyst is injected into the regenerator. In embodiments, less than 1 wt. %, less than 0.5 wt. %, less than 0.1 wt. %, or less than 0.01 wt. % of the heavy hydrocarbon feed 106 may comprise added coke precursors (e.g., compounds not naturally present in the crude oil). In embodiments, less than 1 wt. %, less than 0.5 wt. %, less than 0.1 wt. %, or less than 0.01 wt. % of the light hydrocarbon feed 108 may comprise added coke precursors (e.g., compounds not naturally present in the crude oil or gas condensate).

Still referring to FIGS. 2 and 3, the heavy hydrocarbon feed 106 may be passed to a first FCC reactor unit 120. The heavy hydrocarbon feed 106 may be added to the first catalyst mixing zone 136. The heavy hydrocarbon feed 106 may be combined or mixed with a first catalyst 124 and cracked to produce a mixture of a first spent catalyst 126 and a first cracked effluent 128. The first spent catalyst 126 may be separated from the first cracked effluent 128 and passed to a regeneration zone 162 of the common regenerator 160.

The light hydrocarbon feed 108 may be passed to a second FCC reactor unit 140 that includes a second reaction zone 142. The light hydrocarbon feed 108 may be mixed with a second catalyst 144 and cracked to produce a second spent catalyst 146 and a second cracked effluent 148. The second spent catalyst 146 may be separated from the second cracked effluent 148 and passed to the regeneration zone 162 of the common regenerator 160.

In some embodiments, steam (not shown) may be introduced to the hydrocarbon feed conversion system 100. In embodiments, steam may be introduced to at least one of the heavy hydrocarbon feed 106 and the light hydrocarbon feed 108. Steam may act as a diluent to reduce a partial pressure of the hydrocarbons in at least one of the heavy hydrocarbon feed 106 and the light hydrocarbon feed 108. Steam may reduce secondary reactions and lead to a high yield of light olefins.

The first spent catalyst 126 and the second spent catalyst 146 may be combined and regenerated in the regeneration zone 162 of the common regenerator 160 to produce a regenerated catalyst 116. The regenerated catalyst 116 may have a catalytic activity that is at least greater than the catalytic activity of the first spent catalyst 126 and the second spent catalyst 146. The regenerated catalyst 116 may then be passed back to the first reaction zone 122 and the second reaction zone 142. The first reaction zone 122 and the second reaction zone 142 may be operated in parallel.

It should be understood that, in some embodiments, the first catalyst 124 and the second catalyst 144 are the same in composition, the first catalyst 124 and second catalyst 144 may be regenerated in a regeneration zone 162 of a common regenerator 160, as depicted in FIG. 3.

Still referring to FIGS. 2 and 3, in embodiments, the hydrocarbon feed conversion system 100 may include at least one catalyst recycle, such as second catalyst 144 and second spent catalyst 146. The first cracked effluent 128 and the second cracked effluent 148 each may include a mixture of cracked hydrocarbon materials, which may be further separated into one or more greater value petrochemical products and recovered from the system in the one or more system product streams. For example, the first cracked effluent 128, the second cracked effluent 148, or both may include the petrochemical products. The petrochemical products may be at least one of ethylene, propene, butene, or pentene. For example, the first cracked effluent 128, the second cracked effluent 148, or both may include one or more of cracked gas oil, cracked gasoline, cracked naphtha, mixed butenes, butadiene, propene, ethylene, other olefins, ethane, methane, other petrochemical products, or combinations of these. The cracked gasoline may be further processed to obtain aromatics such as benzene, toluene, xylenes, or other aromatics for example. The hydrocarbon feed conversion system 100 may include a product separator 112. The first cracked effluent 128, the second cracked effluent 148, or both the first cracked effluent 128 and the second cracked effluent 148, may be introduced to the product separator 112 to separate these streams into a plurality of system product streams. In some embodiments, the first cracked effluent 128 and the second cracked effluent 148 may be combined into a combined cracking reaction product stream 114. The combined cracking reaction product stream 114 may be introduced to the product separator 112. Referring to FIGS. 2 and 3, the product separator 112 may be fluidly coupled to the first separation zone 130, the second separation zone 150, or both the first separation zone 130 and the second separation zone 150. In embodiments, the first stripped product stream 134 and the second stripped product stream 154 may be combined to form mixed stripped product stream.

Referring now to FIG. 2, the product separator 112 may be a distillation column or collection of separation devices that separates the 128, the second cracked effluent 148, or the combined cracking reaction product stream 114 into one or more system product streams, which may include one or more a fuel oil stream 181, a gasoline stream 182, a mixed butenes stream 183, a butadiene stream 184, a propene stream 185, an ethylene stream 186, a methane stream 187, light cycle oil streams (e.g., streams boiling in the range from 216° C.-343° C.) 188, heavy cycle oil streams (e.g., streams boiling >343° C.) 189, other product streams, or combinations of these and a hydrogen stream 110. Each system product stream may be passed to one or more additional unit operations for further processing, or may be sold as raw goods. In embodiments, the first cracked effluent 128 and the second cracked effluent 148 may be separately introduced to the product separator 112. As used in this disclosure, the one or more system product streams may be referred to as petrochemical products, which may be used as intermediates in downstream chemical processing or packaged as finished products. The product separator 112 may also produce one or more cycle oil streams, which may be recycled to the hydrocarbon feed conversion system 100.

Referring now to FIG. 3, the first FCC reactor unit 120 may include a first catalyst mixing zone 136, the first reaction zone 122, a first separation zone 130, and a first stripping zone 132. The heavy hydrocarbon feed 106 may be introduced to the first catalyst mixing zone 136, where the heavy hydrocarbon feed 106 may be mixed with the first catalyst 124. During steady state operation of the hydrocarbon feed conversion system 100, the first catalyst 124 may include at least the regenerated catalyst 116 that is passed to the first catalyst mixing zone 136 from a catalyst hopper 174. In embodiments, the first catalyst 124 may be a mixture of first spent catalyst 126 and regenerated catalyst 116. Alternatively, the first catalyst 124 may be a mixture of second spent catalyst 146 and regenerated catalyst 116. The catalyst hopper 174 may receive the regenerated catalyst 116 from the common regenerator 160. At initial start-up of the hydrocarbon feed conversion system 100, the first catalyst 124 may include fresh catalyst (not shown), which is catalyst that has not been circulated through the first FCC reactor unit 120 or the second FCC reactor unit 140 and the common regenerator 160. Because the fresh catalyst has not been circulated through a reaction zone, the fresh catalyst may have a catalytic activity that is greater than the regenerated catalyst 116. In embodiments, fresh catalyst may also be introduced to the catalyst hopper 174 during operation of the hydrocarbon feed conversion system 100 so that a portion of the first catalyst 124 introduced to the first catalyst mixing zone 136 includes the fresh catalyst. Fresh catalyst may be introduced to the catalyst hopper 174 periodically during operation to replenish lost catalyst or compensate for spent catalyst that becomes deactivated, such as through heavy metal accumulation in the catalyst.

In some embodiments, one or more supplemental feed streams (not shown) may be combined with the heavy hydrocarbon feed 106 before introduction of the heavy hydrocarbon feed 106 to the first catalyst mixing zone 136. In other embodiments, one or more supplemental feed streams may be added directly to the first catalyst mixing zone 136, where the supplemental feed stream may be mixed with the heavy hydrocarbon feed 106 and the first catalyst 124 prior to introduction into the first reaction zone 122. In some embodiments, no supplemental feed streams are combined with the heavy hydrocarbon feed 106. As previously described, the supplemental feed stream may include one or more of vacuum residues, tar sands, bitumen, atmospheric residues, vacuum gas oils, demetalized oils, naphtha streams, other hydrocarbon streams, or combinations of these materials.

The mixture comprising the heavy hydrocarbon feed 106 and the first catalyst 124 may be passed from the first catalyst mixing zone 136 to the first reaction zone 122. The mixture of the heavy hydrocarbon feed 106 and first catalyst 124 may be introduced to a top portion of the first reaction zone 122. The first reaction zone 122 may be a down flow reactor or "downer" reactor in which the reactants flow from the first catalyst mixing zone 136 vertically downward through the first reaction zone 122 to the first separation zone 130. The heavy hydrocarbon feed 106 may be reacted by contact with the first catalyst 124 in the first reaction zone 122 to cause at least a portion of the heavy hydrocarbon feed 106 to undergo at least a cracking reaction to form at least one cracking reaction product, which may include at least one of the petrochemical products previously described. The first catalyst 124 may have a temperature equal to or greater than the first cracking temperature $T_{122}$ of the first reaction zone 122 and may transfer heat to the heavy hydrocarbon feed 106 to promote the endothermic cracking reaction.

It should be understood that the first reaction zone 122 of the first FCC reactor unit 120 depicted in FIG. 3 is a simplified schematic of one particular embodiment of the first reaction zone 122 of an FCC unit, and other configurations of the first reaction zone 122 may be suitable for incorporation into the hydrocarbon feed conversion system 100. For example, in some embodiments, the first reaction zone 122 may be an up-flow reaction zone. Other reaction zone configurations are contemplated. The first FCC reactor unit 120 may be a hydrocarbon feed conversion unit in which in the first reaction zone 122, the fluidized first catalyst 124 contacts the heavy hydrocarbon feed 106 under high-severity conditions. The first cracking temperature $T_{122}$ of the first reaction zone 122 may be from 500° C. to 800° C., from 500° C. to 700° C., from 500° C. to 650° C., from 500° C. to 600° C., from 550° C. to 800° C., from 550° C. to 700° C., from 550° C. to 650° C., from 550° C. to 600° C., from 600° C. to 800° C., from 600° C. to 700° C., or from 600° C. to 650° C. In one or more embodiments, the first cracking temperature $T_{122}$ of the first reaction zone 122 may be from 500° C. to 700° C. In one or more embodiments, the first cracking temperature $T_{122}$ of the first reaction zone 122 may be from 550° C. to 630° C.

A weight ratio of the first catalyst 124 to the heavy hydrocarbon feed 106 in the first reaction zone 122 (the catalyst to hydrocarbon ratio) may be from 5:1 to 40:1, from 5:1 to 35:1, from 5:1 to 30:1, from 5:1 to 25:1, from 5:1 to 15:1, from 5:1 to 10:1, from 10:1 to 40:1, from 10:1 to 35:1, from 10:1 to 30:1, from 10:1 to 25:1, from 10:1 to 15:1, from 15:1 to 40:1, from 15:1 to 35:1, from 15:1 to 30:1, from 15:1 to 25:1, from 25:1 to 40:1, from 25:1 to 35:1, from 25:1 to 30:1, from 22:1 to 25:1, from 24:1 to 28:1, or from 30:1 to 40:1. The residence time of the mixture of first catalyst 124 and the heavy hydrocarbon feed 106 in the first reaction zone 122 may be from 0.2 seconds ("sec") to 3 sec, from 0.2 sec to 2.5 sec, from 0.2 sec to 2 sec, from 0.2 sec to 1.5 sec, from 0.4 sec to 3 sec, from 0.4 sec to 2.5 sec, or from 0.4 sec to 2 sec, from 0.4 sec to 1.5 sec, from 1.5 sec to 3 sec, from 1.5 sec to 2.5 sec, from 1.5 sec to 2 sec, or from 2 sec to 3 sec.

The operation of the first reaction zone 122 may convert hydrocarbons in the heavy hydrocarbon feed 106 into coke, which may be deposited upon the first catalyst 124 to form the first spent catalyst 126. This coke may provide heat to regenerate the first spent catalyst 126 and additional heat to regenerate the coke deficient the second spent catalyst 146 in the common regenerator 160. The operation of the first reaction zone 122 may convert from 5 wt. % to 15 wt. % of the hydrocarbons in the heavy hydrocarbon feed 106 into coke. In embodiments, the operation of the first reaction zone 122 may convert from 5 wt. % to 6 wt. %, from 6 wt. % to 7 wt. %, from 7 wt. % to 8 wt. %, from 8 wt. % to 9 wt. %, from 9 wt. % to 10 wt. %, from 10 wt. % to 11 wt. %, from 11 wt. % to 12 wt. %, from 12 wt. % to 13 wt. %, from 13 wt. % to 14 wt. %, from 14 wt. % to 15 wt. %, from 6 wt. % to 9 wt. %, from 8 wt. % to 11 wt. %, or any combination of these ranges, of the hydrocarbons in the heavy hydrocarbon feed 106 into coke.

Following the cracking reaction in the first reaction zone 122, the contents of the effluent from the first reaction zone 122 may include the first catalyst 124 and the first cracked effluent 128, which may then be passed to the first separation zone 130. In the first separation zone 130, the first catalyst 124 may be separated from at least a portion of the first cracked effluent 128. In some embodiments, the first separation zone 130 may include one or more gas-solid separators, such as one or more cyclones. The first catalyst 124 exiting from the first separation zone 130 may retain at least a residual portion of the first cracked effluent 128.

After the first separation zone 130, the first catalyst 124, which may include the residual portion of the first cracked effluent 128 retained in the first catalyst 124, may be passed to a first stripping zone 132, where at least some of the residual portion of the first cracked effluent 128 may be stripped from the first catalyst 124 and recovered as a first stripped product stream 134. The first stripped product stream 134 may be passed to one or more than one downstream unit operations or combined with one or more than one other streams for further processing. Steam 133 may be introduced to the first stripping zone 132 to facilitate stripping the first cracked effluent 128 from the first catalyst 124. The first stripped product stream 134 may include at least a portion of the steam 133 introduced to the first stripping zone 132. The first stripped product stream 134 may be discharged from the first stripping zone 132 may be passed through cyclone separators (not shown) and out of the stripper vessel (not shown). The first stripped product stream 134 may be directed to one or more product recovery systems in accordance with known methods in the art, or may be recycled by combining with steam. The first stripped product stream 134 may also be combined with one or more other streams, such as the first cracked effluent 128, for example. The first stripped product stream 134 may also be combined with the second stripped product stream 154. The first spent catalyst 126, which is the first catalyst 124 after stripping out the first stripped product stream 134, may be passed from the first stripping zone 132 to the regeneration zone 162 of the common regenerator 160 to be regenerated to produce regenerated catalyst 116.

Referring still to FIG. 3, the light hydrocarbon feed 108 may be passed to the second FCC reactor unit 140 (as shown in FIG. 2). The second FCC reactor unit 140 may include a second catalyst mixing zone 156, the second reaction zone 142, a second separation zone 150, and a second stripping zone 152. The catalyst mixing zone may fluidize the catalyst, and may mix the catalyst with process streams such as inert carrier streams or the light hydrocarbon feed 108, if they are injected into the second catalyst mixing zone 156.

As is described herein, the light hydrocarbon feed 108 may be passed to the second FCC reactor unit 140. Without limitation, several embodiments are contemplated for achieving such an arrangement. For example, as is depicted in FIG. 3, the light hydrocarbon feed 108 may be injected into the second reaction zone 142. In another embodiment, the light hydrocarbon feed 108 may be injected into the second catalyst mixing zone 156. While the following disclosure will detail the embodiment depicted in FIG. 3 with respect to the injection of the light hydrocarbon feed 108 (i.e., into the second reaction zone 142), the other embodiments should be considered within the presently disclosed embodiments.

Still referring to FIG. 3, during steady state operation of the hydrocarbon feed conversion system 100, the second catalyst 144 may include at least the regenerated catalyst 116 that is passed to the second catalyst mixing zone 156 from a catalyst hopper 174. In embodiments, the second catalyst 144 may be a mixture of second spent catalyst 146 and regenerated catalyst 116. Alternatively, the second catalyst 144 may be a mixture of first spent catalyst 126 and regenerated catalyst 116. The catalyst hopper 174 may receive the regenerated catalyst 116 from the common regenerator 160 following regeneration of the first spent catalyst 126 and second spent catalyst 146. At initial start-up of the hydrocarbon feed conversion system 100, the second catalyst 144 may include fresh catalyst (not shown), which is catalyst that has not been circulated through the first FCC reactor unit 120 or the second FCC reactor unit 140 and the common regenerator 160. In embodiments, fresh catalyst may also be introduced to catalyst hopper 174 during operation of the hydrocarbon feed conversion system 100 so that at least a portion of the second catalyst 144 introduced to the second catalyst mixing zone 156 includes the fresh catalyst. Fresh catalyst may be introduced to the catalyst hopper 174 periodically during operation to replenish lost catalyst or compensate for spent catalyst that becomes permanently deactivated, such as through heavy metal accumulation in the catalyst.

The second catalyst 144 may be passed from the second catalyst mixing zone 156 to the second reaction zone 142. The second reaction zone 142 may be a down flow reactor or "downer" reactor in which the reactants flow from the second catalyst mixing zone 156 downward through the second reaction zone 142 to the second separation zone 150. The second catalyst 144 may have a temperature equal to or greater than the second cracking average temperature $T_{142}$ of the second reaction zone 142 and may transfer heat to the light hydrocarbon feed 108 to promote the endothermic cracking reaction.

In some embodiments, one or more supplemental feed streams (not shown) may be combined with the light hydrocarbon feed 108 before introduction to the second FCC reactor unit 140. In other embodiments, one or more supplemental feed streams may be added directly to the second FCC reactor unit 140. In other embodiments, no supplemental feed streams are combined with the light hydrocarbon feed 108. The supplemental feed stream may include one or more naphtha streams or other lesser boiling hydrocarbon streams.

It should be understood that the second reaction zone 142 of the second FCC reactor unit 140 depicted in FIG. 3 is a simplified schematic of one particular embodiment of the second reaction zone 142, and other configurations of the second reaction zone 142 may be suitable for incorporation into the hydrocarbon feed conversion system 100. For example, in some embodiments, the second reaction zone 142 may be an up-flow reaction zone. Other reaction zone configurations are contemplated. The second FCC reactor unit 140 may be a hydrocarbon feed conversion unit in which in the second reaction zone 142, the second catalyst 144 contacts the light hydrocarbon feed 108 at high-severity conditions. The second cracking temperature $T_{142}$ of the second reaction zone 142 may be from 500° C. to 800° C., from 500° C. to 700° C., from 500° C. to 650° C., from 500° C. to 600° C., from 550° C. to 800° C., from 550° C. to 700° C., from 550° C. to 650° C., from 550° C. to 600° C., from 600° C. to 800° C., from 600° C. to 700° C., or from 600° C. to 650° C. In some embodiments, the second cracking temperature $T_{142}$ of the second reaction zone 142 may be from 500° C. to 700° C. In other embodiments, the second cracking temperature $T_{142}$ of the second reaction zone 142 may be from 550° C. to 630° C. In some embodiments, the second cracking temperature $T_{142}$ may be different than the first cracking temperature $T_{122}$. In some embodiments, the second cracking temperature $T_{142}$ may be within 50° C., such as within 30° C., within 20° C., within 10° C., or within 5° C. of the first cracking temperature $T_{122}$.

A weight ratio of the second catalyst 144 to the light hydrocarbon feed 108 in the second reaction zone 142 (catalyst to hydrocarbon ratio) may be from 5:1 to 40:1, from 5:1 to 35:1, from 5:1 to 30:1, from 5:1 to 25:1, from 5:1 to 15:1, from 5:1 to 10:1, from 10:1 to 40:1, from 10:1 to 35:1, from 10:1 to 30:1, from 10:1 to 25:1, from 10:1 to 15:1, from 15:1 to 40:1, from 15:1 to 35:1, from 15:1 to 30:1, from 15:1 to 25:1, from 25:1 to 40:1, from 25:1 to 35:1, from 25:1 to 30:1, from 25:1 to 28:1, or from 30:1 to 40:1. In some embodiments, the weight ratio of the second catalyst 144 to the light hydrocarbon feed 108 in the second reaction zone 142 may be different than the weight ratio of the first catalyst 124 to the heavy hydrocarbon feed 106 in the first reaction zone 122. In embodiments, the weight ratio of the second catalyst 144 to the light hydrocarbon feed 108 in the second reaction zone 142 may be at greater than the weight ratio of the first catalyst 124 to the heavy hydrocarbon feed 106 in the first reaction zone 122 by at least 1, at least 2, at least 3, from 1 to 5, from 1 to 4, from 2 to 5, from 2 to 4, or any combination of these ranges. In some embodiments, the weight ratio of the second catalyst 144 to the light hydrocarbon feed 108 in the second reaction zone 142 may be about equal to the weight ratio of the first catalyst 124 to the heavy hydrocarbon feed 106 in the first reaction zone 122. For example, the weight ratio of the second catalyst 144 to the light hydrocarbon feed 108 in the second reaction zone 142 may be within 5, such as within 4, within 3, within 2, or within 1 of weight ratio of the first catalyst 124 to the heavy hydrocarbon feed 106 in the first reaction zone 122. The residence time of the mixture of second catalyst 144 and the light hydrocarbon feed 108 in the second reaction zone 142 may be from 0.2 seconds ("sec") to 3 sec, from 0.2 sec to 2.5 sec, from 0.2 sec to 2 sec, from 0.2 sec to 1.5 sec, from 0.4 sec to 3 sec, from 0.4 sec to 2.5 sec, or from 0.4 sec to 2 sec, from 0.4 sec to 1.5 sec, from 1.5 sec to 3 sec, from 1.5 sec to 2.5 sec, from 1.5 sec to 2 sec, or from 2 sec to 3 sec. In some embodiments, the residence time in the second reaction zone 142 may be different than the residence time in the first reaction zone 122. In some embodiments, the residence time in the second reaction zone 142 may be about equal to than the residence time in the first reaction zone 122.

The operation of the second reaction zone 142 may convert hydrocarbons in the light hydrocarbon feed 108 into coke, which may be deposited upon the second catalyst 144 to form the second spent catalyst 146. The combustion of this coke may provide insufficient heat to regenerate the second spent catalyst 146 in the common regenerator 160. However, the coke deficient second spent catalyst 146 may help prevent the excess coke on the first spent catalyst 126 from overheating the common regenerator 160. The operation of the second reaction zone 142 may convert from 1 wt. % to 7 wt. % of the hydrocarbons in the light hydrocarbon feed 108 into coke. In embodiments, the operation of the second reaction zone 142 may convert from 1 wt. % to 2 wt. %, from 2 wt. % to 3 wt. %, from 3 wt. % to 4 wt. %, from 5 wt. % to 6 wt. %, from 6 wt. % to 7 wt. %, from 4 wt. % to 7 wt. %, from 1.5 wt. % to 4.5 wt. %, or any combination of these ranges, of the hydrocarbons in the light hydrocarbon feed 108 into coke. In some embodiments, the operation of the first reaction zone 122 may convert more of the heavy hydrocarbon feed 106 into coke than the second reaction zone 142 converts of the light hydrocarbon feed 108. In embodiments, the operation of the first reaction zone 122 may convert at least 1 wt. %, at least 2 wt. %, at least 3 wt. %, at least 5 wt. %, from 1 wt. % to 2 wt. %, from 2 wt. % to 3 wt. %, from 3 wt. % to 4 wt. %, from 4 wt. % to 5 wt. %, from 5 wt. % to 6 wt. %, from 6 wt. % to 7 wt. %, from 1 wt. % to 3 wt. %, from 2 wt. % to 4 wt. %, from 5 wt. % to 7 wt. %, or any combination of these ranges more of the heavy hydrocarbon feed 106 into coke than the second reaction zone 142 converts of the light hydrocarbon feed 108 into coke.

Following the cracking reaction in the second reaction zone 142, the contents of effluent from the second reaction zone 142 may include second catalyst 144 and the second cracked effluent 148, which may be passed to the second separation zone 150. In the second separation zone 150, the second catalyst 144 may be separated from at least a portion of the second cracked effluent 148. In embodiments, the second separation zone 150 may include one or more gas-solid separators, such as one or more cyclones. The second catalyst 144 exiting from the second separation zone 150 may retain at least a residual portion of the second cracked effluent 148.

After the second separation zone 150, the second catalyst 144 may be passed to the second stripping zone 152, where at least some of the residual portion of the second cracked effluent 148 may be stripped from the second catalyst 144 and recovered as a second stripped product stream 154. The second stripped product stream 154 may be passed to one or more than one downstream unit operations or combined with one or more than one other streams for further processing. Steam may be introduced to the second stripping zone 152 to facilitate stripping the second cracked effluent 148 from the second catalyst 144. The second stripped product stream 154 may include at least a portion of the steam introduced to the second stripping zone 152 and may be passed out of the second stripping zone 152. The second stripped product stream 154 may pass through cyclone separators (not shown) and out of the stripper vessel (not shown). The second stripped product stream 154 may be combined with the first stripped product stream 134. Combination with other streams is contemplated. For example, the first stripped product stream 134, which may comprise a majority steam, may be combined with steam. In another embodiment, the first stripped product stream 134 may be separated into steam and hydrocarbons, and the steam portion may be combined with steam. The second spent catalyst 146, which is the second catalyst 144 after stripping out the second stripped product stream 154, may be passed from the second stripping zone 152 to the regeneration zone 162 of the common regenerator 160.

Referring to FIG. 3, the same type of catalyst may be used throughout the hydrocarbon feed conversion system 100, such as for the first catalyst 124 and the second catalyst 144. The catalyst (first catalyst 124 and second catalyst 144) used in the hydrocarbon feed conversion system 100 may include one or more fluid catalytic cracking catalysts that are suitable for use in the first reaction zone 122 and the second reaction zone 142. The catalyst may be a heat carrier and may provide heat transfer to the heavy hydrocarbon feed 106 in the first reaction zone 122 operated at high-severity conditions and the light hydrocarbon feed 108 in the second reaction zone 142 operated at high-severity conditions. The catalyst may also have a plurality of catalytically active sites, such as acidic sites for example, that promote the cracking reaction. For example, in embodiments, the catalyst may be a high-activity FCC catalyst having high catalytic activity. Examples of fluid catalytic cracking catalysts suitable for use in the hydrocarbon feed conversion system 100 may include, without limitation, zeolites, silica-alumina catalysts, carbon monoxide burning promoter additives, bottoms cracking additives, light olefin-producing additives, other catalyst additives, or combinations of these components. Zeolites that may be used as at least a portion of the catalyst for cracking may include, but are not limited to Y, REY, USY, RE-USY zeolites, or combinations of these. The catalyst may also include a shaped selective catalyst additive, such as ZSM-5 zeolite crystals or other pentasil-type catalyst structures, which are often used in other FCC processes to produce light olefins and/or increase FCC gasoline octane. In one or more embodiments, the catalyst may include a mixture of a ZSM-5 zeolite crystals and the cracking catalyst zeolite and matrix structure of a typical FCC cracking catalyst. In one or more embodiments, the catalyst may be a mixture of Y and ZSM-5 zeolite catalysts embedded with clay, alumina, and binder.

In one or more embodiments, at least a portion of the catalyst may be modified to include one or more rare earth elements (15 elements of the Lanthanide series of the IUPAC Periodic Table plus scandium and yttrium), alkaline earth metals (Group 2 of the IUPAC Periodic Table), transition metals, phosphorus, fluorine, or any combination of these, which may enhance olefin yield in the first reaction zone 122, second reaction zone 142, or both. Transition metals may include "an element whose atom has a partially filled d sub-shell, or which can give rise to cations with an incomplete d sub-shell" [IUPAC, Compendium of Chemical Terminology, 2nd ed. (the "Gold Book") (1997). Online corrected version: (2006-) "transition element"]. One or more transition metals or metal oxides may also be impregnated onto the catalyst. Metals or metal oxides may include one or more metals from Groups 6-10 of the IUPAC Periodic Table. In some embodiments, the metals or metal oxides may include one or more of molybdenum, rhenium, tungsten, or any combination of these. In one or more embodiments, a portion of the catalyst may be impregnated with tungsten oxide.

Referring to FIG. 3, the first FCC reactor unit 120 and the second FCC reactor unit 140 may share a common regenerator 160. This use of a common regenerator 160, in combination with tailored hydrocarbon feeds, may enable heat balance in the regenerator such that no supplemental fuels, coking agents, or catalyst coolers may be necessary. The first spent catalyst 126 and the second spent catalyst 146 may be passed to the common regenerator 160, where the first spent catalyst 126 and the second spent catalyst 146 are mixed together and regenerated to produce the regenerated catalyst 116. The common regenerator 160 may include the regeneration zone 162, a catalyst transfer line 164, the catalyst hopper 174, and a flue gas vent 166. The catalyst transfer line 164 may be fluidly coupled to the regeneration zone 162 and the catalyst hopper 174 for passing the regenerated catalyst 116 from the regeneration zone 162 to the catalyst hopper 174. In some embodiments, the common regenerator 160 may have more than one catalyst hopper 174, such as a first catalyst hopper (not shown) for the first FCC reactor unit 120 and a second catalyst hopper (not shown) for the second FCC reactor unit 140, for example. In some embodiments, the flue gas vent 166 may be positioned at the catalyst hopper 174.

In embodiments, less than 1 wt. % of supplemental fuels may be added to the common regenerator 160, on the basis of the total weight of spent catalyst passed to the common regenerator 160. Supplemental fuels are any fuels added to the common regenerator 160 to provide additional heat to regenerate the catalyst, above the heat provided the coke on the spent catalyst. Common supplemental fuels include hydrogen gas, methane, carbon monoxide, ethylene, and any other hydrocarbons available. The use of supplemental fuels may increase the cost of operating an FCC and may increase the complexity of the FCC. In embodiments, less than 0.5 wt. %, less than 0.1 wt. %, less than 0.01 wt. % of supplemental fuels may be added to the common regenerator 160, on the basis of the total weight of spent catalyst passed to the common regenerator 160.

In operation, the first spent catalyst 126 and second spent catalyst 146 may be passed from the first stripping zone 132 and the second stripping zone 152, respectively, to the regeneration zone 162. Combustion gas 170 may be introduced to the regeneration zone 162. The combustion gases 170 may include one or more of combustion air, oxygen, fuel gas, fuel oil, other component, or any combinations of these. In the regeneration zone 162, the coke deposited on the first spent catalyst 126 and the second spent catalyst 146 may at least partially oxidize (combusts) in the presence of the combustion gases 170 to form at least carbon dioxide and water. In some embodiments, the coke deposits on the first spent catalyst 126 and second spent catalyst 146 may be fully oxidized in the regeneration zone 162. Other organic compounds, such as residual first cracking reaction product or second cracking reaction product for example, may also oxidize in the presence of the combustion gases 170 in the regeneration zone. Other gases, such as carbon monoxide for example, may be formed during coke oxidation in the regeneration zone 162. Oxidation of the coke deposits produces heat, which may be transferred to and retained by the regenerated catalyst 116.

The common regenerator 160 for regenerating the first spent catalyst 126 and the second spent catalyst 146 may improve the overall efficiency of the hydrocarbon feed conversion system 100. For example, cracking of the light hydrocarbon feed 108 in the second FCC reactor unit 140 may produce less coke deposits on the second spent catalyst 146 compared to cracking of the heavy hydrocarbon feed 106 in the first FCC reactor unit 120. Combustion of the coke deposits on the second spent catalyst 146 during regeneration produces heat, but the amount of coke present on the second spent catalyst 146 may not be sufficient to produce enough heat to conduct the cracking reactions in the second reaction zone 142. Thus, regeneration of the second spent catalyst 146 by itself may not produce enough heat to raise the temperature of the regenerated catalyst 116 to an acceptable second cracking temperature $T_{142}$ in the second reaction zone 142. By comparison, the amount of coke formed and deposited on the first spent catalyst 126 during cracking of the heavy hydrocarbon feed 106 in the first FCC reactor unit 120 may be excessive and require the use of catalyst coolers in order to prevent the temperature $T_{116}$ from being outside the range preferred to produce olefins or from causing material failures. Generally, catalyst coolers refer to physical devices, such as heat exchangers, used to cool catalyst particles. As the amount of coke deposited on the first spent catalyst 126 may be substantially greater than the coke deposits produced in the second reaction zone 142, combustion of the coke deposits on the first spent catalyst 126 during catalyst regeneration may produce sufficient heat to raise the temperature of the regenerated catalyst 116 (including the regenerated catalyst 116 produced from both the first spent catalyst 126 and the second spent catalyst 146) to high-severity conditions, such as a regenerated catalyst temperature $T_{116}$ equal to or greater than the first cracking temperature $T_{122}$ or the second cracking temperature $T_{142}$ for example, and may provide the heat required to conduct the cracking reactions in both the first reaction zone 122 and the second reaction zone 142.

The flue gases 172 may convey the regenerated catalyst 116 through the catalyst transfer line 164 from the regeneration zone 162 to the catalyst hopper 174. The regenerated catalyst 116 may accumulate in the catalyst hopper 174 prior to passing from the catalyst hopper 174 to the first FCC reactor unit 120 and the second FCC reactor unit 140. The catalyst hopper 174 may act as a gas-solid separator to separate the flue gas 172 from the regenerated catalyst 116. In embodiments, the flue gas 172 may pass out of the catalyst hopper 174 through a flue gas vent 166 disposed in the catalyst hopper 174.

The catalyst may be circulated through the first FCC reactor unit 120, the second FCC reactor unit 140, the common regenerator 160, and the catalyst hopper 174. For example, the first catalyst 124 may be introduced to the first FCC reactor unit 120 to catalytically crack the heavy hydrocarbon feed 106 in the first FCC reactor unit 120. During cracking, coke deposits may form on the first catalyst 124 to produce the first spent catalyst 126 passing out of the first stripping zone 132. The first spent catalyst 126 may have catalytic activity that is less than the regenerated catalyst 116, meaning that the first spent catalyst 126 may be less effective at enabling cracking reactions compared to the regenerated catalyst 116. The first spent catalyst 126 may be separated from the first cracked effluent 128 in the first separation zone 130 and the first stripping zone 132. The second catalyst 144 may be introduced to the second FCC reactor unit 140 to catalytically crack the light hydrocarbon feed 108 in the second FCC reactor unit 140. During cracking, coke deposits may form on the second catalyst 144 to produce the second spent catalyst 146 passing out of the second stripping zone 152. The second spent catalyst 146 also may have a catalytic activity that is less than the catalytic activity of the regenerated catalyst 116, meaning that the second spent catalyst 146 may be less effective at enabling the cracking reactions compared to the regenerated catalyst 116. The second spent catalyst 146 may be separated from the second cracked effluent 148 in the second separation zone 150 and the second stripping zone 152. The first spent catalyst 126 and second spent catalyst 146 may then be combined and regenerated in the regeneration zone 162 to produce the regenerated catalyst 116. The regenerated catalyst 116 may be transferred to the catalyst hopper 174.

The regenerated catalyst 116 passing out of the regeneration zone 162 may have less than 1 wt. % coke deposits, based on the total weight of the regenerated catalyst 116. In some embodiments, the regenerated catalyst 116 passing out of the regeneration zone 162 may have less than 0.5 wt. %, less than 0.1 wt. %, or less than 0.05 wt. % coke deposits. In some embodiments, the regenerated catalyst 116 passing out of the regeneration zone 162 to the catalyst hopper 174 may have from 0.001 wt. % to 1 wt. %, from 0.001 wt. % to 0.5 wt. %, from 0.001 wt. % to 0.1 wt. %, from 0.001 wt. % to 0.05 wt. %, from 0.005 wt. % to 1 wt. %, from 0.005 wt. % to 0.5 wt. %, from 0.005 wt. % to 0.1 wt. %, from 0.005 wt. % to 0.05 wt. %, from 0.01 wt. % to 1 wt. %, from 0.01 wt. % to 0.5 wt. % to 0.01 wt. % to 0.1 wt. %, from 0.01 wt. % to 0.05 wt. % coke deposits, based on the total weight of the regenerated catalyst 116. In one or more embodiments, the regenerated catalyst 116 passing out of regeneration zone 162 may be substantially free of coke deposits. As used in this disclosure, the term "substantially free" of a component means less than 1 wt. % of that component in a particular portion of a catalyst, stream, or reaction zone. As an example, the regenerated catalyst 116 that is substantially free of coke deposits may have less than 1 wt. % of coke deposits. Removal of the coke deposits from the regenerated catalyst 116 in the regeneration zone 162 may remove the coke deposits from the catalytically active sites, such as acidic sites for example, of the catalyst that promote the cracking reaction. Removal of the coke deposits from the catalytically active sites on the catalyst may increase the catalytic activity of the regenerated catalyst 116 compared to the first spent catalyst 126 and the second spent catalyst 146. Thus, the regenerated catalyst 116 may have a catalytic activity that is greater than the first spent catalyst 126 and the second spent catalyst 146.

The regenerated catalyst 116 may absorb at least a portion of the heat generated from combustion of the coke deposits. The heat may increase the temperature of the regenerated catalyst 116 compared to the temperature of the first spent catalyst 126 and second spent catalyst 146. The regenerated catalyst 116 may accumulate in the catalyst hopper 174 until it is passed back to the first FCC reactor unit 120 as at least a portion of the first catalyst 124 and the second FCC reactor unit 140 as at least a portion of the second catalyst 144. The regenerated catalyst 116 in the catalyst hopper 174 may have a temperature that is equal to or greater than the first cracking temperature $T_{122}$ in the first reaction zone 122 of the first FCC reactor unit 120, the second cracking temperature $T_{142}$ in the second reaction zone 142 of the second FCC reactor unit 140, or both. The greater temperature of the regenerated catalyst 116 may provide heat for the endothermic cracking reaction in the first reaction zone 122, the second reaction zone 142, or both.

As previously discussed, the heavy hydrocarbon feed 106 and light hydrocarbon feed 108, such as crude oil or whole gas condensate, for example, can have a wide range of compositions and a wide range of boiling points. Because of the difference of compositions, each of the heavy hydrocarbon feed 106 and the light hydrocarbon feed 108 may benefit from different operating temperatures and catalyst activities to produce desired yields of one or more petrochemical products or increase the selectivity of the reaction for certain products. For example, the heavy hydrocarbon feed 106 may be more reactive and, thus, may require less cracking activity than light hydrocarbon feed 108 to produce sufficient yields of or selectivity for a specific petrochemical product. However, the heavy hydrocarbon feed 106 may produce insufficient coke to operate the regenerator. The lesser cracking activity suitable for the heavy hydrocarbon feed 106 may be provided by reducing the catalytic activity of the first catalyst 124 in the first reaction zone 122, reducing the first cracking temperature $T_{122}$ in the first reaction zone 122, or a combination of both. In contrast, the light hydrocarbon feed 108 may be less reactive and may require greater catalytic activity, such as an increased catalytic activity of the second catalyst 144 in the second reaction zone 142, a second cracking temperature $T_{142}$ in the second reaction zone 142 greater than the first cracking temperature $T_{122}$, or both, compared to the heavy hydrocarbon feed 106 to produce sufficient yields of or selectivity for the specific petrochemical products. However, cracking the light hydrocarbon feed 108 alone may produce excess coke, requiring catalyst coolers.

As previously described in this disclosure, the hydrocarbon feed conversion system 100 may include a common regenerator 160 to regenerate the first spent catalyst 126 and the second spent catalyst 146 to produce the regenerated catalyst 116. Therefore, the regenerated catalyst 116 passed to the first FCC reactor unit 120 is the same as and has the same catalytic effectiveness and temperature as the regenerated catalyst 116 passed to the second FCC reactor unit 140. However, as previously discussed, the reaction conditions in the first FCC reactor unit 120 or second FCC reactor unit 140 for producing sufficient yields of or selectivity for specific petrochemical products may be different than the reaction conditions provided by passing the regenerated catalyst 116 to either the first FCC reactor unit 120 or the second FCC reactor unit 140.

EXAMPLES

The various embodiments of methods and systems for the conversion of a feedstock fuels will be further clarified by the following examples. The examples are illustrative in nature, and should not be understood to limit the subject matter of the present disclosure.

In both of the following Example A and Example B, a catalyst blend was utilized. The catalyst blend comprising a blend of 75 wt. % HS-FCC/5a (purchased from JGC Catalysts and Chemicals LTD) and 25 wt. % OlefinsUltra® (purchased from W.R. Grace and Co.) was prepared by physical blending. Prior to the experiment, the catalyst was steam deactivated at 810° C. for 6 hours to mimic the equilibrium catalyst in the commercial process.

Properties of the feeds utilized are given in Table 2, where KGC refers to a Khuff Gas Condensate, AXL refers to an Arab Extra Light Crude Oil, and AH refers to an Arab Heavy Crude Oil.

TABLE 2

| | KGC | AXL | AH |
|---|---|---|---|
| Density @ 15.6° C. ($g/cm^3$) | 0.7695 | 0.822 | 0.893 |
| Nitrogen (ppm) | <10 | 297 | 1952 |
| SULFUR (wt. %) | 0.0271 | 1.697 | 2.68 |
| Fe (ppm) | <20 | <1 | <10 |
| Na (ppm) | 0.05 | <1 | 1 |
| Specific Gravity (at 60° F.) | 0.770026 | 0.8227 | 0.2939 |
| MeABP (° F.) | 151.76 | 493.87 | 695.94 |
| Watson K | 11.02 | 11.96 | 11.74 |
| Molecular Weight (g/mol) | 83.27 | 201.29 | 304.14 |
| API Gravity | 52.26 | 40.5 | 26.80 |

The operation of each of the reaction zones was simulated individually utilizing a Micro Downer Unit (MDU), manufactured by Amtech (as depicted in below figure). To prepare for the experiment, the catalyst was loaded into the hopper and the traps were set. The feed was loaded into the syringe and pump set was prepared. Then, $N_2$ and air were supplied. Next, the heating system was started for catalyst hopper, reactor, and stripper. The temperatures and pressure were allowed to equilibrate to their set points. Liquid products were collected in the traps and gas products were sent to a gas chromatograph (GC) for analysis. Liquid products are then sent for SimDist analysis to determine the composition of gasoline, LCO and HCO. Coke content was measured by catalyst combustion through measuring the released CO2. The results of which are shown in Table 3.

TABLE 3

| Feed | KGC | AXL | AH |
|---|---|---|---|
| Temp (° C.) | 647 | 651 | 645 |
| CAT/OIL | 30 | 32 | 33 |
| Residence time (s) | | ~2 | |
| Catalyst code | | UMix75 (steam deactivated at 810° C. for 6 hours) | |
| Yields (mass %) | | | |
| H2—C2 (dry gas) | 4 | 9 | 9 |
| C2= | 8 | 12 | 11 |
| C3= | 16 | 22 | 23 |

TABLE 3-continued

| Feed | KGC | AXL | AH |
|---|---|---|---|
| C4=s | 9 | 10 | 11 |
| Total light olefins | 33 | 45 | 46 |
| Gasoline | 51 | 30 | 28 |
| Coke | 1.3 | 5 | 8 |

In Examples A and B, the required coke and catalyst to hydrocarbon ratio were determined by simulation, while holding the feed rate (60 KBPD per reactor, total of 120 KBPD for both reactors), feed temperature (300° C.), steam inlet rate (14 wt. % of fresh feed), downer inlet temperature (DIT) (695° C.) and downer outlet temperature (640° C.) constant.

In Example A, KGC was utilized as the light hydrocarbon feed and AH was utilized as the heavy hydrocarbon feed. The results of Example A are shown in Table 4.

TABLE 4

| Example A | | |
|---|---|---|
| Feed | KGC | AH |
| Feed rate (t/h) | 306.35 | 355.62 |
| C/O ratio (wt/wt) | 23.66 | 26.42 |
| Conversion of feed (%) | 99% | 100% |
| Heat of reaction (kcal/kg) | 125.51 | 145.70 |
| Required produced coke (wt % of feed) | 3.00% | 9.27% |

In Example B, AXL was utilized as the light hydrocarbon feed and AH was utilized as the heavy hydrocarbon feed. The results of Example B are shown in Table 5.

TABLE 5

| Feed | AXL | AH |
|---|---|---|
| Feed rate (t/h) | 327.30 | 355.62 |
| C/O ratio (wt/wt) | 26.30 | 26.42 |
| Conversion of feed (%) | 99% | 100% |
| Heat of reaction (kcal/kg) | 134.09 | 145.70 |
| Required produced coke (wt % of feed) | 5.50% | 7.74% |

As can be seen from Table 5, the combination of AXL and AH requires about 13 wt. % of coke production. As can be seen from Table 3, the combination of AXL and AH produces about 13 wt. % of coke production. Thus, the coke needs are balanced and the regenerator may be operated without catalyst coolers or supplemental fuels.

Numerous aspects are included in the present disclosure.

Aspect 1 discloses a method for operating a fluidized catalytic cracker, the method comprising: passing a heavy hydrocarbon feed and a first catalyst to a first reaction zone to produce a first cracked effluent and a first spent catalyst with coke deposited thereon; passing a light hydrocarbon feed and a second catalyst to a second reaction zone to produce a second cracked effluent and a second spent catalyst with coke deposited thereon; passing the first spent catalyst and the second spent catalyst to a common regenerator; in the common regenerator, regenerating the first spent catalyst and the second spent catalyst by combusting coke deposited on the first spent catalyst and the second spent catalyst, thereby forming fresh catalyst, which is passed back to the first reaction zone as the first catalyst and to the second reaction zone as the second catalyst, wherein: the light hydrocarbon feed has an API gravity of from 38° to 55°; the heavy hydrocarbon feed comprises a crude oil and has an API gravity of from 20° to 35°; the first reaction zone and the second reaction zone are each fluidized catalytic cracking zones operated at high severity conditions; and the common regenerator is operated without supplemental fuel or catalyst coolers.

Aspect 2, which includes Aspect 1, discloses that the light hydrocarbon feed comprises a whole crude oil or a whole gas condensate.

Aspect 3, which may include Aspects 1 and/or 2, discloses that the light hydrocarbon feed and the heavy hydrocarbon feed have not been subjected to separation by boiling point.

Aspect 4, which may include any of Aspects 1 to 3, disclose that the API gravity of the light hydrocarbon feed is at least 25° higher than the API gravity of the heavy hydrocarbon feed.

Aspect 5, which may include any of Aspects 1 to 4, discloses that the light hydrocarbon feed, the heavy hydrocarbon feed, or both are hydrotreated feed streams.

Aspect 6, which may include any of Aspects 1 to 5, discloses that the light hydrocarbon feed comprises Arab Extra Light crude oil or Khuff Gas Condensate.

Aspect 7, which may include any of Aspects 1 to 6, discloses that the heavy hydrocarbon feed is Arab Heavy crude oil.

Aspect 8, which may include any of Aspects 1 to 7, discloses that the first reaction zone is operated at a first cracking temperature; the second reaction zone is operated at a second cracking temperature; and the first cracking temperature is within 10° C. of the second cracking temperature.

Aspect 9, which may include any of Aspects 1 to 8, discloses the heavy hydrocarbon feed has an API gravity of from 24° to 30°; the light hydrocarbon feed has an API gravity of from 50° to 55°; the first reaction zone is operated at a catalyst to hydrocarbon ratio of from 15:1 to 40:1; the second reaction zone is operated at a catalyst to hydrocarbon ratio of from 15:1 to 40:1; and the catalyst to hydrocarbon ratio of the second reaction zone minus the catalyst to hydrocarbon ratio of the first reaction zone is at least 1.

Aspect 10, which may include any of Aspects 1 to 9, discloses that the first reaction zone converts from 8 wt. % to 11 wt. % of the heavy hydrocarbon feed to coke, and the second reaction zone converts from 1.5 wt. % to 4.5 wt. % of the light hydrocarbon feed to coke.

Aspect 11, which may include any of Aspects 1 to 10, discloses that: the heavy hydrocarbon feed has an API gravity of from 24° to 30°; and a catalyst to hydrocarbon ratio of the second reaction zone minus a catalyst to hydrocarbon ratio of the first reaction zone less than 1.

Aspect 12, which may include any of Aspects 1 to 11, discloses that: the first reaction zone converts from 6 wt. % to 10 wt. % of the heavy hydrocarbon feed to coke; the second reaction zone converts from 4 wt. % to 7 wt. % of the light hydrocarbon feed to coke; and the first reaction zone coverts at least 2 percentage points more of the heavy hydrocarbon feed to coke than the second reaction zone coverts of the light hydrocarbon feed to coke.

Aspect 13, which may include any of Aspects 1 to 12, discloses that no coke precursors are introduced to the heavy hydrocarbon feed or to the light hydrocarbon feed.

Aspect 14, which may include any of Aspects 1 to 13, discloses that the first reaction zone and the second reaction zone are each independently operated at a temperature of greater than or equal to 580° C., a weight ratio of the catalyst to the hydrocarbon feed of from 15:1 to 40:1, and a residence time of from 0.1 seconds to 60 seconds.

Aspect 15, which may include any of Aspects 1 to 14, discloses that the first reaction zone and the second reaction zone are each operated in a down-flow configuration.

For the purposes of describing and defining the present disclosure it is noted that the terms "about" or "approximately" are utilized in this disclosure to represent the inherent degree of uncertainty that may be attributed to any quantitative comparison, value, measurement, or other representation. The terms "about" and/or "approximately" are also utilized in this disclosure to represent the degree by which a quantitative representation may vary from a stated reference without resulting in a change in the basic function of the subject matter at issue.

It is noted that one or more of the following claims utilize the term "wherein" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

Any quantitative value expressed in the present application may be considered to include open-ended embodiments consistent with the transitional phrases "comprising" or "including" as well as closed or partially closed embodiments consistent with the transitional phrases "consisting of" and "consisting essentially of."

It is also noted that recitations herein of "at least one" component, element, etc., should not be used to create an inference that the alternative use of the articles "a" or "an" should be limited to a single component, element, etc.

What is claimed is:

1. A method for operating a fluidized catalytic cracker, the method comprising:

passing a heavy hydrocarbon feed and a first catalyst to a first reaction zone to produce a first cracked effluent and a first spent catalyst with coke deposited thereon, wherein an entirety of hydrocarbons fed to the first reaction zone consists of the heavy hydrocarbon feed;

passing a light hydrocarbon feed and a second catalyst to a second reaction zone to produce a second cracked effluent and a second spent catalyst with coke deposited thereon, wherein an entirety of hydrocarbons fed to the second reaction zone consists of the light hydrocarbon feed;

passing the first spent catalyst and the second spent catalyst to a common regenerator;

in the common regenerator, regenerating the first spent catalyst and the second spent catalyst by combusting coke deposited on the first spent catalyst and the second spent catalyst, thereby forming fresh catalyst, which is passed back to the first reaction zone as the first catalyst and to the second reaction zone as the second catalyst, wherein:

the light hydrocarbon feed has an API gravity of from 38° to 55°;

the heavy hydrocarbon feed comprises a crude oil and has an API gravity of from 20° to 35°;

the first reaction zone and the second reaction zone are each fluidized catalytic cracking zones operated at high severity conditions; and the common regenerator is operated without supplemental fuel or catalyst coolers.

2. The method of claim 1, wherein the light hydrocarbon feed comprises a whole crude oil or a whole gas condensate.

3. The method of claim 2, wherein the light hydrocarbon feed and the heavy hydrocarbon feed have not been subjected to separation by boiling point.

4. The method of claim 1, wherein the API gravity of the light hydrocarbon feed is at least 25° higher than the API gravity of the heavy hydrocarbon feed.

5. The method of claim 1, wherein the light hydrocarbon feed, the heavy hydrocarbon feed, or both are hydrotreated feed streams.

6. The method of claim 2, wherein the light hydrocarbon feed comprises Arab Extra Light crude oil or Khuff Gas Condensate.

7. The method of claim 1, wherein the heavy hydrocarbon feed is Arab Heavy crude oil.

8. The method of claim 1, wherein:

the first reaction zone is operated at a first cracking temperature;

the second reaction zone is operated at a second cracking temperature; and the first cracking temperature is within 10° C. of the second cracking temperature.

9. The method of claim 1, wherein:

the heavy hydrocarbon feed has an API gravity of from 24° to 30°;

the light hydrocarbon feed has an API gravity of from 50° to 55°;

the first reaction zone is operated at a catalyst to hydrocarbon ratio of from 15:1 to 40:1;

the second reaction zone is operated at a catalyst to hydrocarbon ratio of from 15:1 to 40:1; and the catalyst to hydrocarbon ratio of the second reaction zone minus the catalyst to hydrocarbon ratio of the first reaction zone is at least 1.

10. The method of claim 8, wherein:

the first reaction zone converts from 8 wt. % to 11 wt. % of the heavy hydrocarbon feed to coke; and the second reaction zone converts from 1.5 wt. % to 4.5 wt. % of the light hydrocarbon feed to coke.

11. The method of claim 1, wherein:

the heavy hydrocarbon feed has an API gravity of from 24° to 30°; and a catalyst to hydrocarbon ratio of the second reaction zone minus a catalyst to hydrocarbon ratio of the first reaction zone less than 1.

12. The method of claim 11, wherein:

the first reaction zone converts from 6 wt. % to 10 wt. % of the heavy hydrocarbon feed to coke;

the second reaction zone converts from 4 wt. % to 7 wt. % of the light hydrocarbon feed to coke; and the first reaction zone converts at least 2 percentage points more of the heavy hydrocarbon feed to coke than the second reaction zone converts of the light hydrocarbon feed to coke.

13. The method of claim 1, wherein no coke precursors are introduced to the heavy hydrocarbon feed or to the light hydrocarbon feed.

14. The method of claim 1, wherein the first reaction zone and the second reaction zone are each independently operated at a temperature of greater than or equal to 580° C., a weight ratio of the catalyst to the hydrocarbon feed of from 15:1 to 40:1, and a residence time of from 0.1 seconds to 60 seconds.

15. The method of claim 1, wherein the first reaction zone and the second reaction zone are each operated in a downflow configuration.

16. The method of claim 1, wherein an API gravity of hydrocarbons in the first reaction zone is from 38° to 55°; and an API gravity of hydrocarbons in the second reaction zone is from 20° to 35°.

17. The method of claim 16, wherein:

the API gravity of the light hydrocarbon feed is at least 25° higher than the API gravity of the heavy hydrocarbon feed;

the light hydrocarbon feed comprises a whole crude oil or a whole gas condensate; and the light hydrocarbon feed and the heavy hydrocarbon feed have not been subjected to separation by boiling point.

18. The method of claim 17, wherein:

the first reaction zone is operated at a first cracking temperature;

the second reaction zone is operated at a second cracking temperature; and the first cracking temperature is within 10° C. of the second cracking temperature.

19. The method of claim 1, wherein:

the light hydrocarbon feed comprises a whole crude oil or a whole gas condensate;

the light hydrocarbon feed and the heavy hydrocarbon feed have not been subjected to separation by boiling point;

the API gravity of the light hydrocarbon feed is at least 25° higher than the API gravity of the heavy hydrocarbon feed;

the first reaction zone is operated at a first cracking temperature, the second reaction zone is operated at a second cracking temperature, and the first cracking temperature is within 10° C. of the second cracking temperature;

the heavy hydrocarbon feed has an API gravity of from 24° to 30°, and the light hydrocarbon feed has an API gravity of from 50° to 55°;

the first reaction zone and the second reaction zone are operated at a catalyst to hydrocarbon ratio of from 15:1 to 40:1;

the catalyst to hydrocarbon ratio of the second reaction zone minus the catalyst to hydrocarbon ratio of the first reaction zone is at least 1; and the first reaction zone converts at least 2 percentage points more of the heavy hydrocarbon feed to coke than the second reaction zone converts of the light hydrocarbon feed to coke.

* * * * *